United States Patent [19]

Bochmann

[11] 4,150,820

[45] Apr. 24, 1979

[54] MOTORIZED SWING

[75] Inventor: Carl E. Bochmann, Brecksville, Ohio

[73] Assignee: Hedstrom Co., Bedford, Pa.

[21] Appl. No.: 805,693

[22] Filed: Jun. 13, 1977

[51] Int. Cl.[2] ..... A63G 9/16

[52] U.S. Cl. ..... 272/86

[58] Field of Search ..... 272/86–92; 273/105.1, 102 AP, 102.1 E; 248/370

[56] References Cited

U.S. PATENT DOCUMENTS

| | | | |
|---|---|---|---|
| 1,458,049 | 6/1923 | Grieshaber | 272/86 |
| 2,024,855 | 12/1935 | Goetter | 272/86 |
| 2,564,547 | 8/1951 | Schrougham | 272/86 |
| 2,609,031 | 9/1952 | Puscas | 272/86 |
| 2,807,309 | 9/1957 | Saint et al. | 272/86 |
| 3,146,985 | 9/1954 | Grudoski | 272/86 |
| 3,526,400 | 9/1970 | Carpenter et al. | 272/86 |
| 3,573,867 | 3/1971 | Mehren | 273/55 R |

FOREIGN PATENT DOCUMENTS

| | | | |
|---|---|---|---|
| 499812 | 2/1954 | Canada | 272/86 |

*Primary Examiner*—Richard C. Pinkham
*Assistant Examiner*—T. Brown
*Attorney, Agent, or Firm*—Cesari and McKenna

[57] ABSTRACT

A child's motorized swing includes a frame from which a seat is suspended by spaced-apart hangers pivotally connected to the frame so that the seat and its occupant can swing like a pendulum. A battery operated drive unit mounted on the frame adjacent one of the hangers rotates a small crank situated adjacent the hanger. A resilient, lost motion linkage connected between the hanger and the rotating crank applies reinforcing impulses to the hanger which maintain the weighted seat in oscillation at its natural frequency.

12 Claims, 5 Drawing Figures

MOTORIZED SWING

BACKGROUND OF THE INVENTION

This invention relates to a child's swing. It relates more particularly to a motorized swing which is driven by rechargeable batteries.

There are various types of motorized swings available for entertaining children. Most such swings are driven by spring-type motors which have run times of only a few minutes. Therefore their motors must be rewound relatively often requiring older children or adults to be present at the swing sites.

It has been proposed to use a battery operated electric motor to drive a child's swing. However, such battery operated swings have not been widely used for a variety of reasons. Usually they require relatively powerful electric motors which are expensive. Also they consume an appreciable amount of power so that they have relatively short run times before their batteries have to be recharged. Attempts to alleviate these problems by using smaller, less expensive motors which draw less current have resulted in the motors not being able to drive the swings properly in many situations as when the occupant is relatively heavy or shifts his weight about. Also some prior swings cannot tolerate the abuse to which they are invariably subjected when children suddenly stop the swing seat or push the seat in a direction contrary to its motor driven direction. The swings stall and in extreme cases their motors burn out. Thus all of these problems have militated against the wider use of battery operated swings.

SUMMARY OF THE INVENTION

Accordingly, the present invention aims to provide a child's battery operated swing that can run for a relatively long time without its batteries being recharged.

A further object of the invention is to provide a swing of this general type which is relatively inexpensive to make.

Still another object of the invention is to provide a child's motorized swing whose oscillations are not affected appreciably by movements of the child in the swing seat.

Yet another object of the invention is to provide a motorized swing which can accommodate children having a wide variety of different sizes and weights.

Another object is to provide a motorized swing whose oscillations will self start when the seat is stationary.

Still another object is to provide a swing of this general type which can withstand its seat being suddenly stopped or pushed in a contrary direction.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

In general, the present swing comprises a foldable frame from which a seat is swingably suspended by means of hangers pivotally connected to opposite sides of the frame. A battery operated motor unit is mounted on the frame adjacent one of the hangers. The unit includes a small DC electric motor connected by way of an ON/OFF switch to one or more rechargeable batteries in the unit. The motor unit also has a plug in electrical contact with the batteries at which connection may be made to an AC to DC converter to recharge the batteries when needed.

The motor operates through a speed reduction gear chain to rotate a small crank positioned adjacent the hanger, with the axis of rotation of the crank being parallel to the pivot axis of the hanger. A resilient linkage extends between the hanger and the crank. While one end of the linkage is connected directly to the hanger, there is a lost motion connection between the other end of the linkage and the crank. In effect, then, the linkage constitutes a flexible, resilient extension of the hanger beyond its pivot to the frame so that when the crank is rotated, it tilts the linkage back and forth about the hanger pivot, so that reinforcing impulses are applied to the hanger causing the hanger to swing back and forth about its pivot to the frame. Consequently, the seat and its contents oscillate like a pendulum relative to the frame.

The provision of resilient, lost motion linkage between the motor crank and the seat partially decouples the motion of the seat from the rotary motion of the crank so that the swing seat oscillates at a frequency that is determined primarily by the mass of the seat and its contents and the length of the hangers rather than by the frequency of the crank. Thus, when the motor is turned on, the crank rotates and provides impulses through the resilient linkage to the weighted swing seat during successive revolutions of the crank that cause the seat to commence oscillating from a standstill and to continue oscillating with ever-increasing amplitude until the weighted seat reaches its natural frequency. Thereupon the seat oscillates at that frequency until the motor is shut off. Changes in the weight distribution in the swing seat are reflected only as transient perturbations in the natural swinging motion of the seat. Furthermore, even if the seat should be stopped abruptly by the occupant or by a playmate, the linkage between the seat and the crank permits the crank to continue to turn so that there is not appreciable strain on the motor or current drain on the batteries.

In a preferred swing embodiment, a spring is included between the opposite hanger and the frame that acts in opposition to the resilient linkage to minimize current drain, to assist the swing to self-start and also to accentuate the excursions of the seat with a light-weight occupant, while inhibiting them when a heavy child resides in the seat.

Thus with the present arrangement, run times on the order of 1½ to 2 hours are possible on a single battery charge. Also, the swing is able to accommodate children whose weight may vary from as little as 9 to as much as 30 lbs., and even self-start over that weight range. Finally, the present construction permits the swing to operate in a fail-safe mode so that if the swing seat is stopped abruptly or an excessively heavy weight is placed in the seat, the motor crank is still able to turn so that there is no tendency for the motor to overheat or burn out. Yet with all of these advantages, the inclusion of the motor unit on the swing does not substantially increase the overall cost of the swing.

BRIEF DESCRIPTION OF THE DRAWINGS

For a fuller understanding of the nature and objects of the invention, reference should be had to the following detailed description taken in connection with the accompanying drawings in which.

DESCRIPTION OF THE PREFERRED EMBODIMENT

Figure 1:
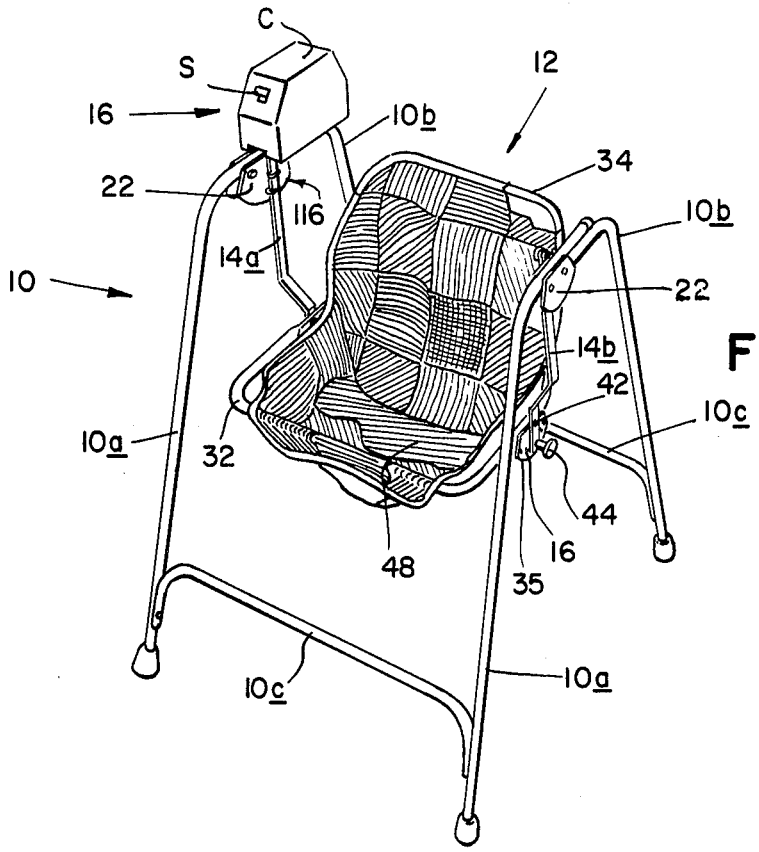
FIG. 1 is a perspective view of a child's motorized swing embodying the principles of this invention.

Turning now to FIG. 1 of the drawings, the swing comprises a frame indicated generally at 10 from which a seat 12 is swingably suspended above the ground by a pair of elongated hangers 14*a* and 14*b*. Oscillatory back and forth motion is imparted to seat 12 by means of a cordless motor unit indicated generally at 16 mounted on frame 10.

Figure 2:
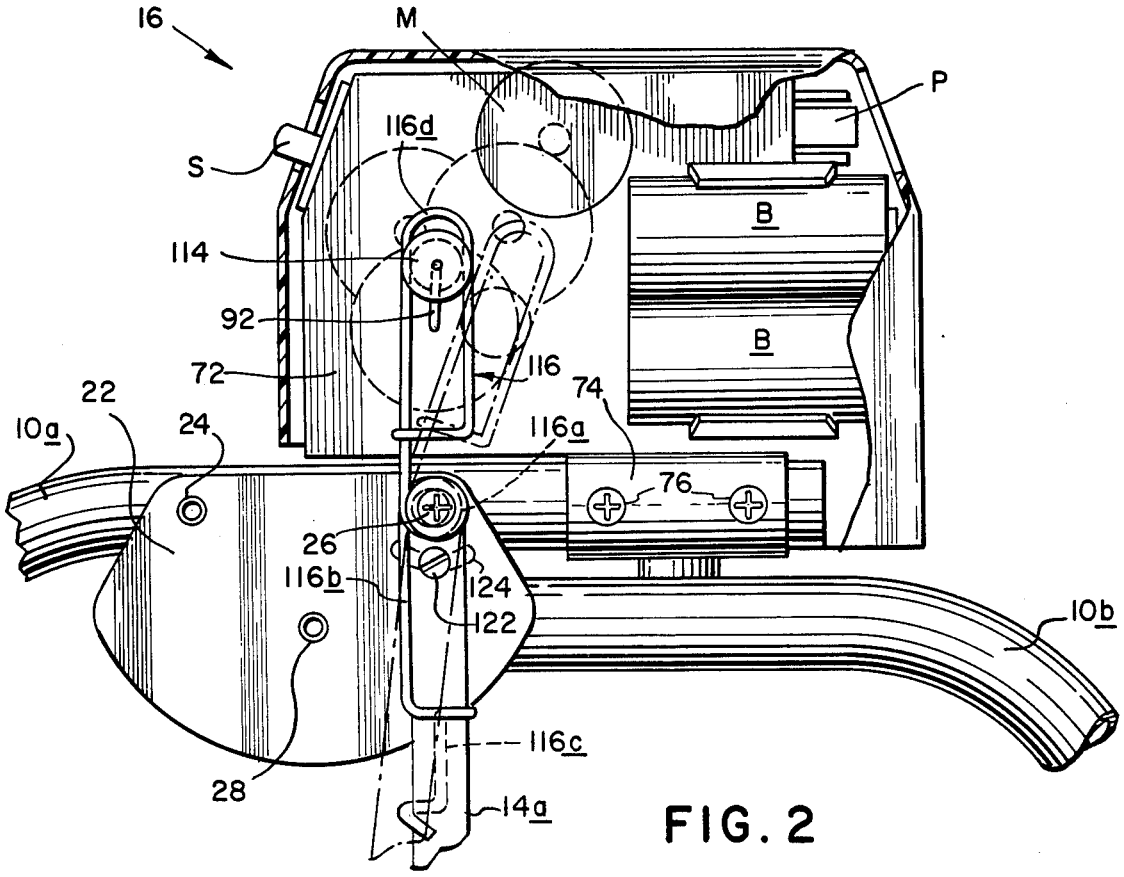
FIG. 2 is a side elevational view with parts cut away on a larger scale showing the swing motor unit in greater detail.
Figure 4:
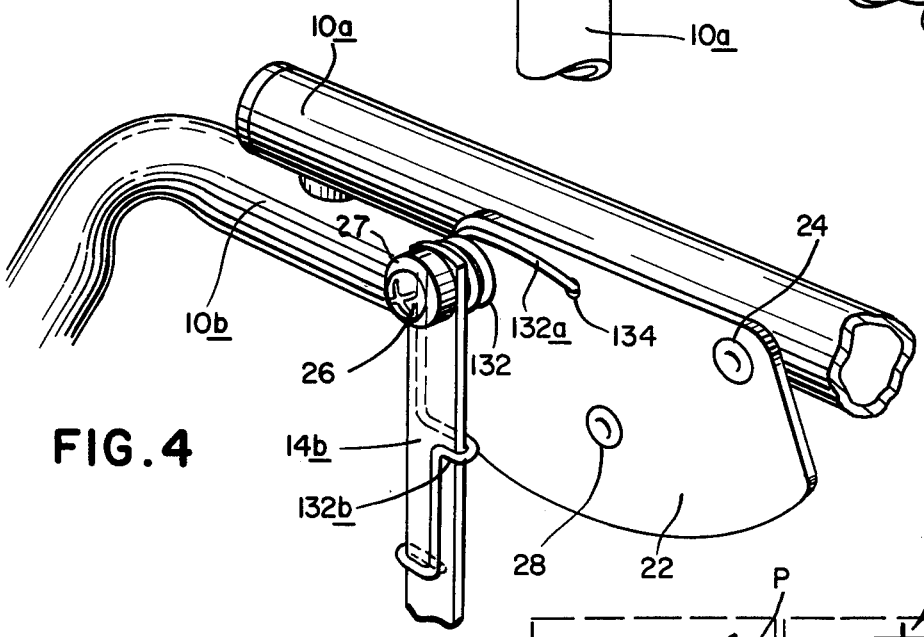
FIG. 4 is a fragmentary perspective view illustrating another part of the swing in greater detail.

Frame 10 comprises a pair of identical, spaced-apart, upstanding forward frame members 10*a* and a pair of identical, upstanding, spaced-apart rear frame members 10*b*. The bottom ends of each pair of frame members are secured together by a cross frame member 10*c*. As best seen in FIGS. 1, 2 and 4, the upper ends of the frame members 10*a* and 10*b* at each side of the swing are bent toward one another with the upper ends of frame members 10*a* overlying the ends of frame members 10*b*. Further, each pair of overlying frame ends are pivotally connected together by a plate 22. More particularly, each plate 22 is secured to frame member 10*a* at its upper edge by a rivet 24 and a bolt 26. The bolts 26 extend through washers 27, through the ends of hangers 14*a* and 14*b* respectively, through plates 22 and through frame members 10*a*, being secured there by lock nuts (not shown). A single river 28 pivotally connects each plate 22 to the adjacent frame member 10*b*. Thus the frame members 10*a* and 10*b* at each side of the swing can be folded together about rivet 28 so that the swing can be stored in a relatively small space when not in use.

Figure 3:
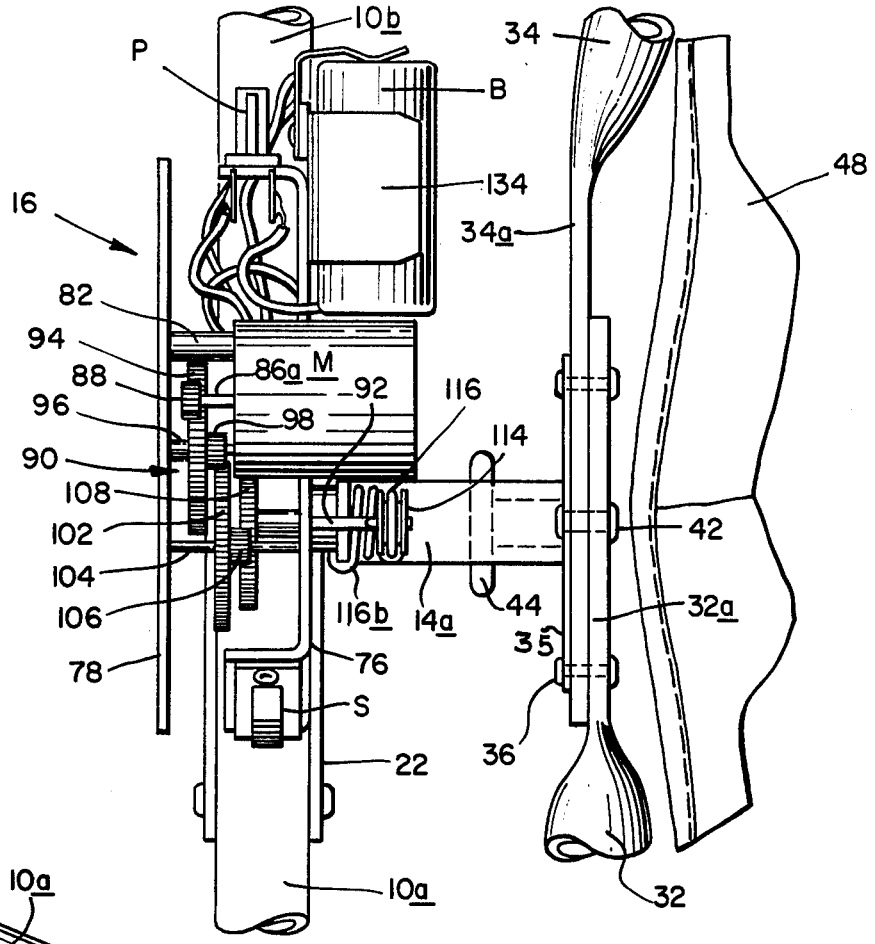
FIG. 3 is a top plan view of the motor unit.

As best seen in FIGS. 1 and 3, seat 12 comprises a generally U-shaped body bow 32 and a U-shaped back bow 34 whose ends 32*a* and 34*a* respectively are flattened, superimposed on one another and secured together along with a plate 35 by means of rivets 36 (FIG. 3). The hangers 14*a* and 14*b* are pivotally connected near their lower ends to the opposite plates 35 by means of rivets 42 which extend through the plates and bow ends 32*a* and 34*a*. Also a standard spring-loaded pull button 44 is connected to the lower end of each of the hangers 14*a* and 14*b*. The inner end of the pull button shaft is arranged to engage in one or another opening 46 of a series in plate 35 to set the orientation of seat 12 relative to hangers 14*a* and 14*b*. This arrangement permits the seat to be positioned in an upright or a more reclined position. Finally, the seat 12 includes a fabric body 48 that engages over, and is removably secured to, the body and back bows 32 and 34 to support the child.

Turning now to FIGS. 2 and 3, the motor unit 16 comprises a generally vertical plate 72 having a tab 74 projecting down from its lower edge and curved to conform to frame member 10*a*. The tab is secured to that frame member by means of screws 76 so that the plate is maintained in a generally vertical plane. Spaced from plate 76 is a second vertically oriented plate 78 which is maintained in spaced-apart, parallel relation to plate 76 by means of standoffs 82 connected between those two plates.

A small, inexpensive DC electric motor M is mounted in an appropriately-sized opening in plate 76 so that the motor shaft projects into the space between the two plates. Typically the motor should draw 0.5 to 1 amp. and rotate at about 5600 rmp, ±5%. A pinion 88 connected to the end of the motor shaft operates through a three-stage, speed-reducing (e.g. 100 to 1) gear chain indicated generally at 90 to rotate a crank 92 best seen in FIG. 2.

Gear chain 90 comprises a relatively large diameter, pinion-engaging spur gear 94 mounted on an axle 96 whose opposite ends are journaled in plates 76 and 78. A relatively small diameter spur gear 98 also rotating with axle 96 engages a large diameter spur gear 102 mounted on an axle 104 whose ends are journaled in plates 76 and 78. Finally the gear chain 90 includes a small diameter spur gear 106 rotating with axle 104 that engages a large diameter spur gear 108 mounted on an axle 110 journaled in plates 76 and 78. The crank 92 is actually an extension of axle 110. It projects beyond plate 76 toward seat 12 and carries a small rotatable pulley 114 at its free end.

Rotation of the crank 92 imparts oscillatory motion to hanger 14*a* by way of a resilient, lost motion linkage shown generally at 116. The linkage is actually a specially shaped, relatively stiff wire spring. As best seen in FIGS. 2 and 3, the linkage comprises a coil section 116*a* which loosely engages around the bolt 26 securing the hanger 14*a* to plate 22 and frame member 10*a*. The linkage also includes a lower section 116*b* at the outboard end of the coil section 116*a* that extends downward flush against hanger 14*a*. Further, the lowest section 116*c* of the linkage is bent so that it encircles hanger 14*a* thereby trapping it. The portion of the linkage at the inboard end of coil section 116*a* extends vertically upward and is bent to form an elongated loop 116*d* having parallel sides which loosely trap the pulley 114 on the end of crank 92.

It should be understood that the linkage 116 fits somewhat loosely on bolt 26, hanger 14*a* and pulley 114 so that the linkage is free to shift laterally slightly to accommodate minor irregularities in the movement of the crank 92 and small lateral displacements of the hanger 14*a*. Preferably also a screw 122 is turned down into hanger 14*a* just below bolt 26. The end of the screw projects into an arcuate slot 124 formed in plate 22. The engagement of the screw 122 with the opposite ends of the slot 124 limits the excursions of hanger 14*a* and thus seat 12 for safety reasons.

Turning now to FIG. 4, in the preferred swing embodiment a coil spring 132 is engaged over the bolt 26 securing hanger 14*b* to plate 22. The spring is situated between the hanger and the plate and its end 132*a* adjacent the plate is retained in a small opening 134 in the plate. A wire length 132*b* at the opposite end of the spring extends downward and is bent to encircle and trap hanger 14*b*. The spring 132 is wound so that it tends to bias hanger 14*b* rearwardly or clockwise as viewed in FIG. 4. In other words, the coil spring 132 opposes the linkage section 116*a* at the opposite side of the swing.

Figure 5:
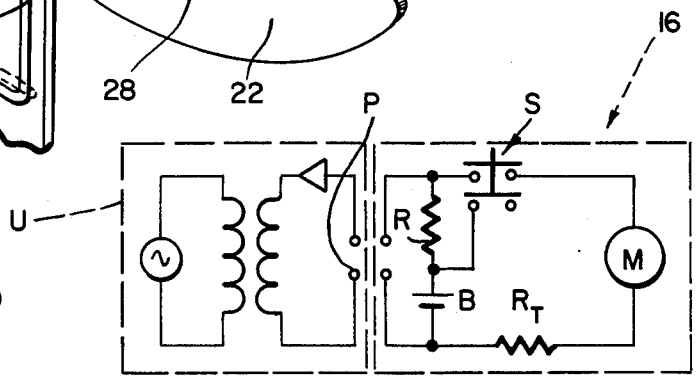
FIG. 5 is a schematic view of the electrical components of the swing.

Referring again to FIGS. 2 and 3, the motor M is powered by one or more standard rechargeable nickel cadmium batteries B, rated at 1.5 volts. The batteries are retained in unit 16 by means of a clip 134 secured to plate 76 and are connected to motor M by way of an ON/OFF switch S. Also the batteries may be recharged by applying to a plug P, the output of a standard wall charging unit. FIG. 5 shows the electrical connections between the various electrical components of motor unit 16 and a charging unit U. A dropping resistor R is included in series with the batteries and the charging unit to limit the current through the batteries when they are being recharged. Also it has been found that the speeds of inexpensive motors such as motor M change during the first five minutes of operation. Consequently, after this amount of break-in time, a trim resister $R_T$ is connected in series between the batteries and the motor for speed trimming purposes.

Finally, the motor unit 16 is provided with a removable cover C which protectively encloses its various components. Of course the cover has the appropriate openings to accommodate the switch S and the plug P.

During normal operation, the swing is powered by the batteries B assuming they are charged. Alternatively, it can be driven directly by the output from the charging unit U applied to plug P. When the switch S is turned to its ON position, current from one or the other of these sources is applied to motor M which thereupon turns crank 92 clockwise in the direction indicated by the arrow in FIG. 2 at a speed on the order of 50 to 56 rpm.

As the crank turns to 90°, its vertical motion component is accommodated by pulley 114 travelling along the linkage loop **116*d* while the loop is tilted rearwardly to its dotted line position shown in FIG. 2. This movement tightens the linkage coil 116*a* so that the linkage lower section 116*c* and hanger 14*a* are moved forwardly as indicated in dotted lines in that same figure. Since the linkage is flexible, the angular movement of hanger 14*a* is somewhat less than that of loop 116*d*. Also, because of the rotational inertia associated with hanger 14*a* and seat 12 as a whole, the motion of the hanger lags behind that of the loop. As the crank moves toward 270°, it tilts the loop 116*d* forwardly. This motion tends to unwind the linkage coil 116*a* so that relatively little counterclockwise motion is coupled to the hanger 14*a***.

Thus as the crank turns, the linkage loop **116*d*, is tilted back and forth so that successive reinforcing forward impulses are applied to hanger 14*a*. These impulses cause the hanger and seat 12** as a whole to swing back and forth with progressively larger excursions until the seat reaches its natural frequency that is determined by the length of the hangers and the total mass of the seat and its contents.

Thus during normal operation of the swing, the linkage 116 partially decouples the motion of the seat from the motion of the crank so that the oscillation frequency of the seat is detemined primarily by its own mechanical characteristics rather than by the frequency of the crank. The crank merely serves to reinforce the seat oscillations from time to time to sustain the oscillatory motion of the swing seat. Actually when the crank 92 typically turns 55 to 60 rpm, the seat 12 oscillates at a frequency of only 46 to 48 cpm. The degree of coupling between the crank and the seat motions depends primarily on the stiffness of linkage 116. If the weight in seat 12 is small, linkage 116 can be relatively stiff. However, if larger weights are likely to be encountered, the linkage should be less stiff, as it should also be as the ratio of the crank speed to seat speed increases.

Since the flexible, resilient lost motion linkage 116 partially decouples the motions of the seat 12 and crank 92, the speed of the crank can remain constant even though the natural frequency of the weighted swing seat may vary as different size children repose in the seat. By the same token, the motion of the crank is relatively unaffected by sudden shifts in the center of mass of the weighted swing seat as the child rocks and squirms in the seat. The lost motion linkage 116 even isolates the crank and thereby motor M from the effects of abrupt changes in the natural oscillatory motion of the seat caused by someone suddenly stopping the seat in mid-swing or even pushing it in a contrary direction. The linkage simply flexes as required to enable the crank 92 to continue to turn with the pulley 114 riding up and down loop **116*d***. Thus with the present arrangement, there is very little chance of stresses being reflected back to motor M which stresses might tend to cause the motor to overheat or burn out. Likewise, the current drain on the batteries B is kept to a minimum so that the swing can operate for as long as two hours on a single battery charge.

In practice, it has been found that for some weight distributions in seat 12, the swing seat sometimes suffers an over excursion in the forward direction and does not self-start from a stationary position because the seat does not swing rearwardly fast enough to receive reinforcing impulses from the crank. For this reason, the preferred swing embodiment includes the spring 132 on hanger **14*b* that opposes the bias of linkage 116**.

The inclusion of the bucking spring 132 also tends to accentuate the excursions of the swing seat for weights at the lower end of the weight range while curbing the excursions for weights at the upper end of the range. In other words, the amplitude of the seat oscillations normally tends to vary directly with the weight in the seat. The spring 132 inhibits that relationship so that the excursions of the seat are relatively independent of the weight in the seat. Thus whether the seat 12 contains a 9 lbs. child or a 30 lbs. child, it swings substantially the same distance, e.g. 10 to 12 inches.

The smoothing out of the oscillatory motion of the seat through spring 132 has a beneficial side effect in that transient variations in the current drawn by motor M at different points in the crank cycle are minimized. Whereas without the spring, the motor M might draw as much as 3 amps at a particular point in the crank cycle, the inclusion of spring 132 reduces that transient current draw by as much as half or more. Resultantly, the time interval between battery charges is maximized.

It will be seen from the foregoing then that my motorized swing is able to operate for a relatively long time on a single battery charge. Also its motion is relatively insensitive to changes in the weight or weight distribution in the swing seat. Likewise the motor unit is relatively unaffected by abrupt changes in the oscillatory motion of the seat that occur when the seat is suddenly stopped or pushed in a contrary direction. Still, however, the swing is driven by a motor unit consisting simply of a very small inexpensive DC motor that operates through a gear chain to turn a crank. Consequently, the cost of the motor unit and thus the swing as the whole is kept to a minimum.

It will thus be seen that the objects set forth above among those made apparent from the preceding description are efficiently attained, and since certain changes may be made in the above construction without departing from the scope of the invention, it is intended that all matter contained in the above description or shown in the accompanying drawings be interpreted as illustrative and not in a limiting sense.

It is also to be understood that the following claims are intended to cover all of the generic and specific features of the invention herein described.

I claim:

1. A child's motorized swing comprising

A. a frame,

B. a seat,

C. a pair of elongated rigid hangers connected to opposite sides of said seat,

D. pivots connecting said hangers to the frame so that said seat can swing relative to the frame, E. a flexible resilient member projecting from one of said hangers adjacent to its pivot to the frame, said flexible resilient member comprising 1. a lever having two ends and a fulcrum located intermediate said ends at said one hanger pivot, said lever end being connected to said one hanger below its said pivot and the other lever end extending perpendicular to said one hanger pivot and being deflectable, and 2. a coil spring engaged on said one hanger pivot, and F. a motor unit mounted on the frame adjacent said member, said motor unit including an actuator which applies periodic impulses to said other lever end that deflect said other end in opposite directions about said one pivot so that when said other end is deflected in one direction about said one pivot, said coil is tightened and when said other end is deflected in the opposite direction about said one pivot said coil is loosened whereby there is a preferential coupling of impulses to said hangers which sustain the hangers and the seat supported thereby in oscillation at a frequency determined primarily by the length of the hangers and the mass of the seat and its contents.

2. The swing defined in claim 1 wherein the motor unit includes

A. a crank engaging the linkage,

B. a small DC motor for rotating the crank at a selected frequency,

C. a DC power supply electrically connected to power the motor, and

D. a switch electrically connected between the power supply and the motor.

3. The swing defined in claim 2 and further including speed reducing means connected between the motor and the crank so that the speed of the crank is a small fraction of the motor speed.

4. The swing defined in claim 2

A. wherein the power supply is a battery, and

B. further including an electrical plug connected across the battery terminals for receiving the output of a AC to DC charging unit.

5. The swing defined in claim 4 and further including a charging unit having its output terminals electrically connected to the plug.

6. The swing defined in claim 2 wherein the linkage includes a lost motion connection to the crank which translates the rotary motion of the crank to oscillatory motion of the linkage.

7. The swing defined in claim 2 wherein the oscillation frequency of the seat is appreciably less than said frequency of the crank.

8. The swing defined in claim 1 wherein the motor unit also includes a motor speed trimming resistor connected between the power supply and the motor.

9. The swing defined in claim 1

A. wherein the actuator is an eccentric member rotatively mounted about an axis parallel to the pivot axis, and B. the motor unit includes a small DC motor for rotating the eccentric member about its axis.

10. The swing defined in claim 9 wherein the eccentric member is a crank.

11. The swing defined in claim 1 and further including a second coil spring mounted between the other hanger and the frame adjacent the other hanger pivot, said second coil spring being arranged to oppose the bias of the first-mentioned spring.

12. In a child's motorized swing of the type including a frame, a seat, a pair of elongated hangers connected to opposite sides of the seat and pivots connecting each of the hangers to the frame so that the seat can swing relative to the frame and a motor unit for oscillating the seat, the improvement comprising A. a spring including a coil engaged on one hanger pivot and a pair of spring ends projecting from the opposite ends of said coil, one of said spring ends being connected to the hanger suspended from said one pivot, the other spring end extending perpendicular to said one pivot, and B. wherein said motor unit includes means for deflecting said other spring end in opposite directions about said one pivot so that when said other spring end is deflected in one direction about said pivot said spring coil is tightened and when said other spring end is deflected in the opposite direction about said pivot said spring coil is loosened whereby there is a preferential coupling of impulses from said motor unit to said hangers which sustain the hangers and the seat supported thereby in oscillation at a frequency determined primarily by the length of the hangers and the mass of the seat and its contents.

* * * * *